US008487534B2

(12) United States Patent
Caiafa et al.

(10) Patent No.: US 8,487,534 B2
(45) Date of Patent: Jul. 16, 2013

(54) PIERCE GUN AND METHOD OF CONTROLLING THEREOF

(75) Inventors: Antonio Caiafa, Niskayuna, NY (US); Xi Zhang, Ballston Lake, NY (US); Vance Robinson, Niskayuna, NY (US); Sergio Lemaitre, Whitefish Bay, WI (US)

(73) Assignee: General Electric Company, Niskayuna, NY (US)

( * ) Notice: Subject to any disclaimer, the term of this patent is extended or adjusted under 35 U.S.C. 154(b) by 522 days.

(21) Appl. No.: 12/750,841

(22) Filed: Mar. 31, 2010

(65) Prior Publication Data

US 2011/0241575 A1 Oct. 6, 2011

(51) Int. Cl.
*H01J 25/50* (2006.01)
*H05B 31/26* (2006.01)

(52) U.S. Cl.
USPC ..... 315/39.57; 315/111.31; 315/111.81

(58) Field of Classification Search
USPC ..... 315/379, 104, 112, 194, 291, 160, 315/300, 302, 307–308, 39–39.77, 500–507, 315/111.01–111.91; 378/16, 111, 113, 109, 378/127
See application file for complete search history.

(56) References Cited

U.S. PATENT DOCUMENTS

| | | | | |
|---|---|---|---|---|
| 3,882,339 | A * | 5/1975 | Rate et al. | 378/124 |
| 3,887,839 | A * | 6/1975 | Ota et al. | 315/383 |
| 5,332,945 | A | 7/1994 | True | |
| 5,550,432 | A * | 8/1996 | Barker | 315/5 |
| 6,252,344 | B1 * | 6/2001 | Ooae et al. | 313/413 |
| 7,085,351 | B2 * | 8/2006 | Lu et al. | 378/122 |
| 7,800,312 | B2 * | 9/2010 | Horsky | 315/111.81 |
| 2002/0125841 | A1 | 9/2002 | Mako et al. | |
| 2004/0264643 | A1 | 12/2004 | Chretien | |
| 2008/0187093 | A1 * | 8/2008 | Price et al. | 378/19 |
| 2010/0207527 | A1 * | 8/2010 | Hruby et al. | 315/111.01 |

FOREIGN PATENT DOCUMENTS

| | | | |
|---|---|---|---|
| DE | 10211947 | A1 | 10/2003 |
| JP | 8195294 | A | 7/1996 |
| JP | 2000260594 | A | 9/2000 |
| WO | 2008050670 | A1 | 5/2008 |

OTHER PUBLICATIONS

Extended Search Report from corresponding EP Application No. 11159674.8-2208 dated Dec. 16, 2011.

Vaughan, "Synthesis of a Hollow-Beam Pierce Gun," IEEE: Transactions on Electron Devices, Feb. 1987, vol. ED-34, No. 2, pp. 468-472.

* cited by examiner

*Primary Examiner* — Jimmy Vu
*Assistant Examiner* — Henry Luong
(74) *Attorney, Agent, or Firm* — Seema S. Katragadda

(57) ABSTRACT

A system and method for controlling the temperature of both an electron emitter and a filament to their lowest possible operating temperature is disclosed. The apparatus includes a filament, an electron emitter heated by the filament to generate an electron beam, and a power supply configured to supply power to each of the filament and the electron emitter. The apparatus also includes a control system to control a supply of power to each of the filament and the electron emitter, with the control system being configured to receive an input indicative of a desired electron emitter operating temperature, cause a desired voltage to be applied between the electron emitter and the filament, and cause a desired voltage to be applied to the filament based on the desired emitter element operating temperature, so as to minimize an operating temperature of the electron emitter and the filament.

9 Claims, 8 Drawing Sheets

52
82
Vac FIXED 56
90
APPLY Vemit-fil ESTABLISHED IN THE PREVIOUS LOOP
98
APPLY Vemit-fil SUCH THAT Vemit-fil =Papp/I(PROBE2)
92
READ I(t)=I(PROBE2)
94
96
IS TIMER=0
NO
YES
100
112
110
IS I(PROBE2) < Ifil-init
NO
102
IS I(PROBE2) > Ifil-init
NO
YES
114
118
INCREASE Vac
116
YES
104
108
DECREASE Vac
START/RESTART TIMER
106

PIERCE GUN AND METHOD OF CONTROLLING THEREOF

BACKGROUND OF THE INVENTION

The present invention relates generally to a Pierce-type electron gun, and, more particularly, to a system and method for controlling operation of a Pierce-type electron gun to control current density in the electron beam and control the operating temperature of the electron emitter and the filament, so as to keep the temperature of both the electron emitter and the filament to their lowest possible operating temperature.

X-ray tubes typically include a cathode structure that provides an electron beam that is accelerated using a high voltage applied across a cathode-to-anode vacuum gap to produce x-rays upon impact with a rotating anode. The area where the electron beam impacts the anode is often referred to as the focal spot. Typically, the cathode includes one or more cylindrical or flat filaments positioned within a cup for providing electron beams to create a high-power large focal spot or a high-resolution small focal spot, as examples. Imaging applications may be designed that include selecting either a small or a large focal spot having a particular shape, depending on the application.

One specified cathode structure for generating the electron beam is a Pierce-type electron gun. The Pierce-type electron gun includes a heating filament, an electron emissive cathode, field shaping electrodes and a first extraction plate spaced from the cathode, and an X-ray target anode spaced from the extraction plate. A particular embodiment of such a Pierce gun is disclosed in U.S. Pat. No. 3,882,339. Such electron guns are typically operated in space charge limited regime and the emission current can be readily controlled by adjusting the extraction voltage. Such a gun would be particularly suited to produce electron beams with rapidly variable amperage.

One drawback to existing Pierce-type electron guns is the control of voltage, and the control and limitation of the power needed to keep the emitter and filament at the proper operating temperatures. In order to extend the life of the components, the various temperatures need to be as small as possible compatibly with the proper operation. Additionally, the control needs to be done with the least number of feedback lines possible and these lines should not come from inside the vacuum chamber, and additional equipment inside the chamber (e.g., to measure temperature) should be avoided.

Thus, a need exists for a system and method that allows for control of electron beam intensity in a very fast fashion by quick application of a voltage generated by a voltage supply. It would also be desirable to have a system that allows for controlling the temperature of the emitter in a fast and accurate fashion while minimizing the operating temperature of both the filament and the emitter.

BRIEF DESCRIPTION OF THE INVENTION

Embodiments of the invention overcome the aforementioned drawbacks by providing an apparatus to control current density in the electron beam and control the operating temperature of the electron emitter and the filament, so as to keep the temperature of both the electron emitter and the filament to their lowest possible operating temperature.

According to one aspect of the invention, an apparatus includes a filament configured to generate heat when a voltage is applied thereto, an electron emitter heated by the filament to generate an electron beam, and a power supply configured to supply power to each of the filament and the electron emitter, the power supply including a plurality of voltage supplies. The apparatus also includes a control system to control a supply of power to each of the filament and the electron emitter, with the control system being configured to receive an input indicative of a desired electron emitter operating temperature, cause a desired voltage to be applied between the electron emitter and the filament, and cause a desired voltage to be applied to the filament based on the desired emitter element operating temperature, so as to minimize an operating temperature of the electron emitter and the filament.

According to another aspect of the invention, a method for controlling operation of an electron gun includes instituting a first control loop to control a current in an electron beam, wherein instituting the first control loop further includes providing a desired electron beam current, applying a potential between the electron emitter and the extraction electrode to generate an electron beam having the desired current, and applying the electron beam for a desired period of time. The method also includes instituting a second control loop to control an operating temperature of the electron emitter and the filament, wherein instituting the second control loop further includes providing a desired electron emitter operating temperature, applying a potential between the electron emitter and the filament and a potential across the filament, so as to control the operating temperature of the electron emitter and the filament.

According to yet another aspect of the invention, a control system includes including a processor programmed to receive an input indicative of a desired electron beam current, an electron beam emission time duration, and a desired electron emitter operating temperature, cause a voltage to be applied between the electron emitter and the extraction electrode for the desired time interval and based on the desired electron beam current, and cause an initial voltage to be applied between the electron emitter and the filament based on the desired emitter element operating temperature. The processor is further programmed to cause an initial filament voltage to be applied based on the initial voltage between the emitter element and the filament, compare a measured filament current value to an initial filament current value, with the initial filament current value associated with the initial filament voltage and a voltage between the electron emitter element and the filament, and modify each of the initial filament voltage and the initial voltage between the electron emitter and the filament based on the comparison of the measured filament current and the initial filament current.

These and other advantages and features will be more readily understood from the following detailed description of preferred embodiments of the invention that is provided in connection with the accompanying drawings.

BRIEF DESCRIPTION OF THE DRAWINGS

The drawings illustrate embodiments presently contemplated for carrying out the invention.

In the drawings.

DETAILED DESCRIPTION OF THE INVENTION

Figure 1:
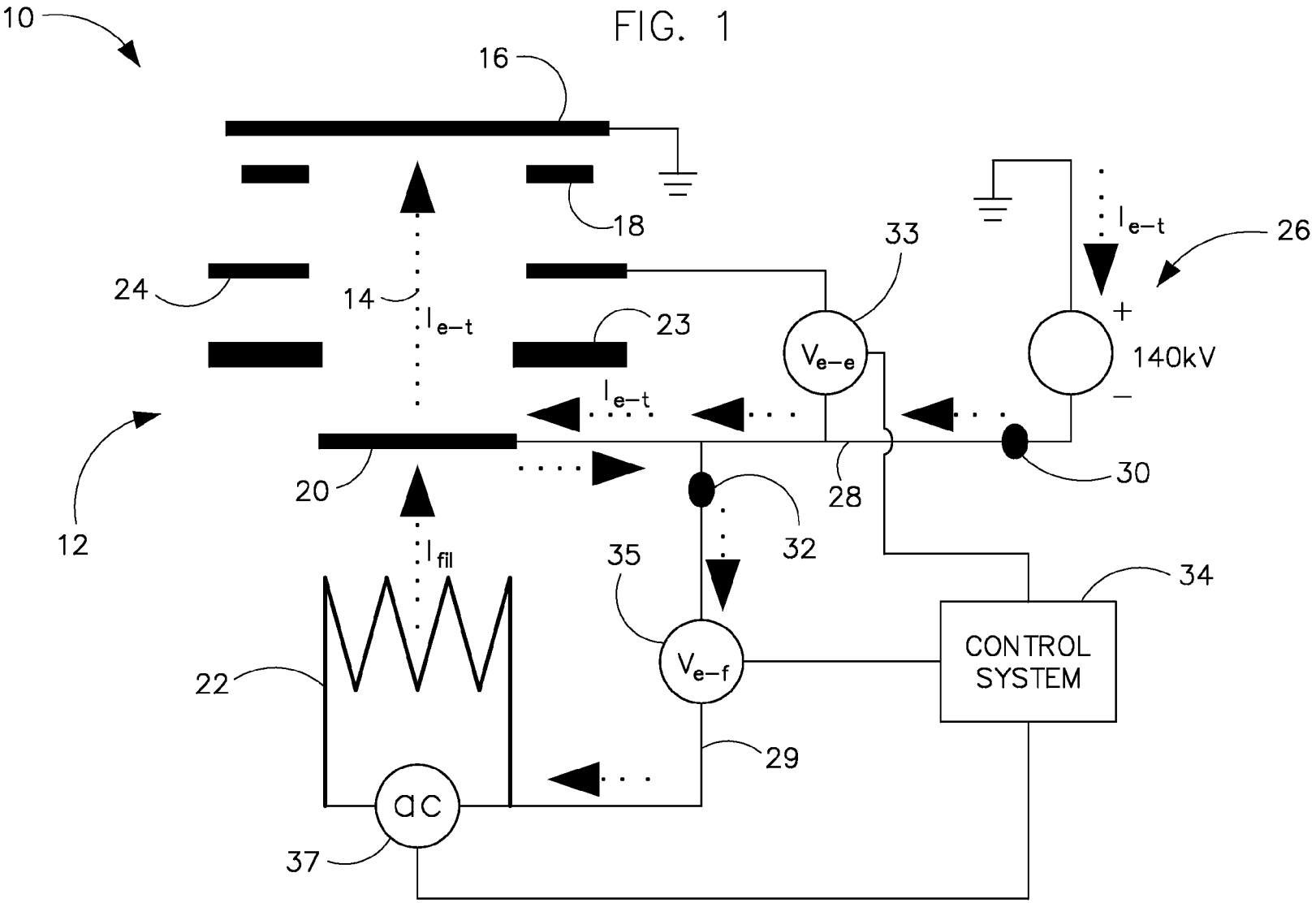
FIG. 1 is a block schematic diagram of an electron gun in accordance with an embodiment of the present invention.

Referring to FIG. 1, a block schematic diagram of an apparatus 10 is depicted according to one embodiment of the invention. Apparatus 10 is configured to control the temperature of both an electron emitter 20 and a filament 22 included therein such that the electron emitter and filament 22 are kept to their lowest possible operating temperature. According to an exemplary embodiment of the invention, apparatus 10 is a Pierce-type of electron gun that includes a cathode structure, generally designated by the number 12, configured to generate a beam of electrons 14 that is directed from cathode 12 to the beveled periphery (not shown) of a target anode 16. The electron beam 14 is focused in a spot from which a beam of X-rays emanates as anode 16 rotates. Also included in electron gun 10 is an accelerating anode assembly 18 (i.e., formed as a beam collector when implemented in an x-ray tube) interposed between cathode structure 12 and target anode 16. The electron beam 14 from cathode structure 12 passes through an aperture of accelerating assembly 18 and finally impinges on target anode 16. Generally speaking, a cathode structure such as 12 and an accelerating anode 18 are the principal elements of a Pierce-type electron gun, such as electron gun 10.

As shown in FIG. 1, cathode structure 12 is configured as a thermionic cathode that, according to one embodiment, is essentially a metallic block having an electron emitter element 20 that forms an emitting surface (e.g., concave emitting surface). The electron emitter element 20 is composed mainly of a refractory metal such as tungsten impregnated with barium carbonate, for example, to enhance its thermionic emissivity. One or more filaments or heating elements 22 are positioned adjacent electron emitter element 20 such that, when the filament(s) 22 are energized, and a voltage $V_{e\text{-}f}$ is applied, they raise the temperature of the emitter element 20 to emission temperature. A control voltage may then be applied to electron emitter element 20 to generate electron beam 14, which can be focused by focusing electrodes 23 positioned adjacent electron emitter element 20.

Also included in cathode structure 12 is an extraction plate 24 that functions to extract electron beam 14 from electron emitter element 20 by applying a positive $V_{e\text{-}e}$ voltage, or block the electron beam 14 by applying a negative $V_{e\text{-}e}$ voltage. Extraction plate 24 is separated apart from electron emitter element 20, so that an electrical potential or voltage may be applied between extraction plate 24 and electron emitter element 20.

Each of the electron emitter element 20, filament 22, and extraction plate 24 are connected to a power supply 26, which is outside a vacuum chamber (not shown), by way electrical path(s)/connection(s) 28, 29. The power supply 26 selectively applies a power to each of the electron emitter element 20, filament 22, and extraction plate 24, with the voltage applied to each component being individually controllable, as will be explained in greater detail below, by way of voltage sources 33, 35, 37, that apply voltages $V_{e\text{-}e}$, $V_{e\text{-}f}$, Vac, respectively. Thus, when referring to power source 26, voltage sources 33, 35, 37 are also referenced. Also included in electron gun 10 are first and second probes 30, 32 configured to measure current at desired locations along the electrical paths 28, 29. A first probe 30 is positioned along electrical path 28 to measure a current of electron beam 14 generated by electron emitter element 20. A second probe 32 is positioned along electrical path 29 to measure the current emitted by filament 22.

As shown in FIG. 1, a control system 34 is included in electron gun 10 to control voltage supplied from power supply 26 to each of the electron emitter element 20, filament 22, and extraction plate 24. That is, the control system 34 individually controls the magnitude of the voltages supplied to each of the emitter element 20, filament 22, and extraction plate 24. The control system 34 is thus configured to control a voltage to the filament ($V_{ac}$), a voltage between the electron emitter element and the filament ($V_{e\text{-}f}$), and a voltage between the electron emitter element and the extraction plate ($V_{e\text{-}e}$). Moreover, the control system 34 is configured to selectively cause emission of electron beam 14 by applying voltage on the extraction plate 24 only when emission is required, and only after the voltage $V_{e\text{-}e}$ is regulated to the desired value. When emission is not desired, the control system 34 keeps the voltage between the emitter and the extraction plate, $V_{e\text{-}e}$, to a negative value. According to embodiments of the invention, control system 34 can regulate the magnitude of the voltages supplied to each of the emitter element 20, filament 22, and extraction plate 24 by way of any of various devices (not shown) connected to power source 26 and positioned along electrical paths 28, 29, such as silicon and silicon carbide switches, diodes, and the like, such that voltage sources $V_{e\text{-}e}$, $V_{e\text{-}f}$, and Vac are provided for emitter element 20, filament 22, and extraction plate 24.

In operation, control system 34 functions to control a current in the electron beam 14 and control an operating temperature of the electron emitter 20 and the filament 22, so as to keep the temperature of both the electron emitter 20 and the filament 22 to their lowest possible operating temperature. The control system 34 can be described as being configured to institute/implement two control loops for controlling operation of electron gun 10. A first control loop is instituted for controlling the current in the electron beam 14. A second control loop is instituted for controlling the operating temperature of the electron emitter 20 and the filament 22, so as to keep the temperature of both the electron emitter 20 and the filament 22 to their lowest possible operating temperature. It is recognized that the "first" and "second" designations of the control loops are for identification purposes only, and do not suggest a particular order of implementation. According to one embodiment of the invention, the second control loop is implemented prior to, or simultaneously with, the first control loop. Control of electron gun 10 by way of the first and second control loops allows for controlling of the electron beam current intensity in a very fast fashion, while also allowing for simultaneous controlling of the temperature of the electron emitter element 20 in a fast and accurate fashion.

Figure 2:
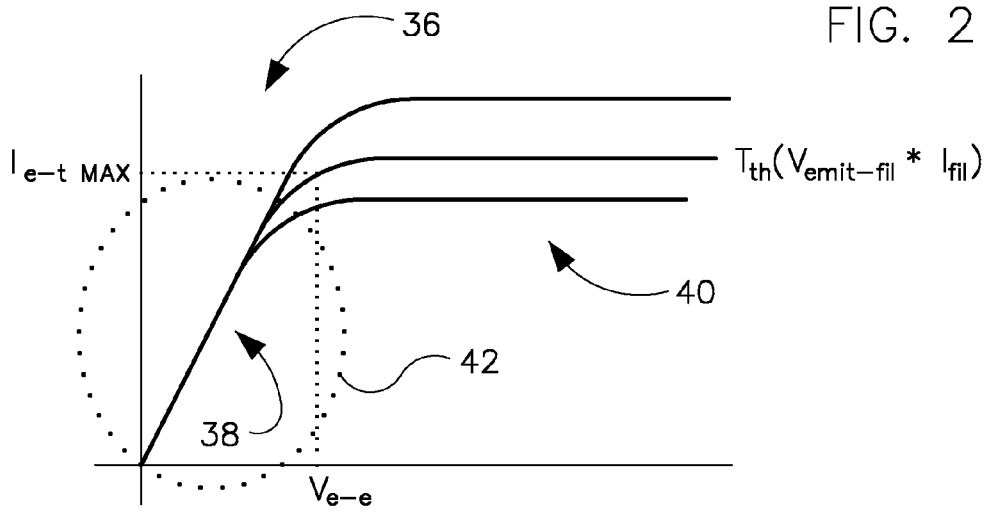
FIG. 2 is a graph that illustrates controlling of the current in the electron beam in the electron gun of FIG. 1.

In order to control the current in the electron beam 14 and control the operating temperature of the electron emitter 20 and the filament 22, control system 34 controls the voltage to the filament ($V_{ac}$), the voltage between the electron emitter element and the filament ($V_{e-f}$), and the voltage between the electron emitter element and the extraction plate ($V_{e-e}$). Referring now to FIG. 2, a graph is provided that illustrates controlling of the current in the electron beam 14 according to the first control loop. The x-axis corresponds to the voltage between the electron emitter element and the extraction plate, $V_{e-e}$, and the y-axis corresponds to a current of the emitted electron beam, $I_{e-t}$. As shown in FIG. 2, a curve 36 is provided indicative of a relationship between $V_{e-e}$ and $I_{e-t}$, such that emission of an electron beam having a desired current density requires application of a corresponding voltage between the electron emitter element and the extraction plate. The curve 36 includes a linear portion 38 and a "saturated" portion 40, with the saturated portion 40 being affected by an operating temperature of the electron emitter element, $T_{emit}$. In operation of electron gun 10 (FIG. 1), controlling of the current in the electron beam is performed in a desired control zone 42 located in the linear portion 38 of curve 36. The linear portion 38 corresponds to a space charge limited mode of operation of the electron emitter element. Operation of the electron emitter element in the space charge limited mode allows for controlling of the electron beam current intensity in a very fast fashion.

Figure 3:
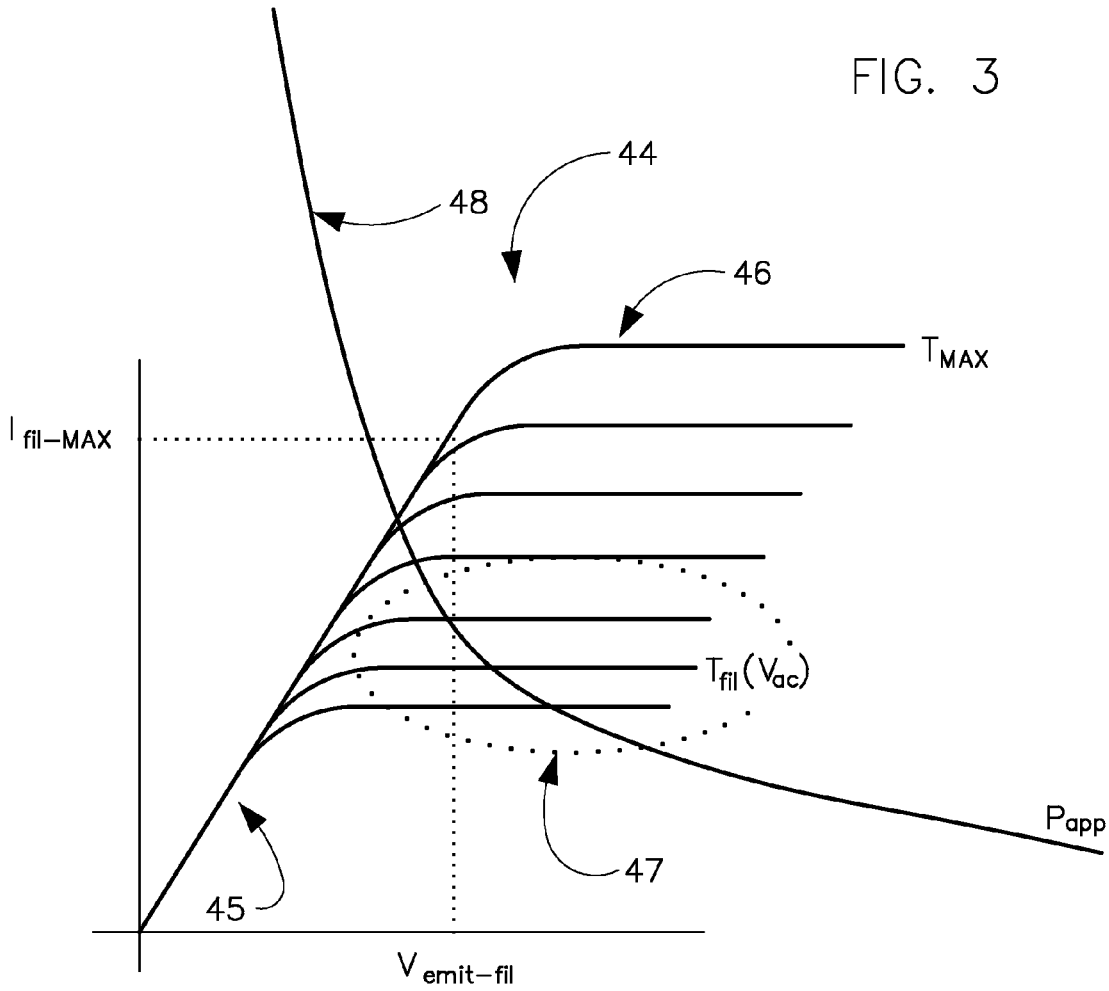
FIG. 3 is a graph that illustrates controlling of the operating temperature of the electron emitter and the filament in the electron gun of FIG. 1.

Referring now to FIG. 3, a graph is provided that illustrates controlling of the operating temperature of the electron emitter and the filament according to the second control loop. The x-axis corresponds to the voltage between the electron emitter element and the filament, $V_{e-f}$, and the y-axis corresponds to the current emitted by the filament, $I_{fil}$. As shown in FIG. 3, a curve 44 is provided indicative of a relationship between $V_{e-f}$ and $I_{fil}$. The curve 44 includes a linear portion 45 and a "saturated" portion 46, with the saturated portion and threshold voltage ($V_{emit-fil}$) being affected by an operating temperature of the filament, $T_{fil}$, and with the threshold voltage being the voltage corresponding to the transition from linear to saturated behavior (given a temperature $T_{fil}$). In operation of electron gun 10 (FIG. 1), controlling of the operating temperature of the electron emitter is performed in the control zone 42 and controlling of the operating temperature of the filament is performed by controlling the filament in a desired control zone 47 located in the saturated portion 46 of curve 44, and according to a constant power curve 48. The saturated portion 46 corresponds to a temperature limited mode of operation of the filament. Operation of the filament in the temperature limited mode provides for controlling of the temperature of the electron emitter element in the charge limited mode that, in turn, provides for controlling of the electron beam 14 (FIG. 1) intensity in a fast and accurate fashion, avoidance of temperature spikes, and maintaining of the temperature of both the electron emitter and the filament at their lowest possible operating temperature so as to optimize lifetime of the components.

Figure 4B:
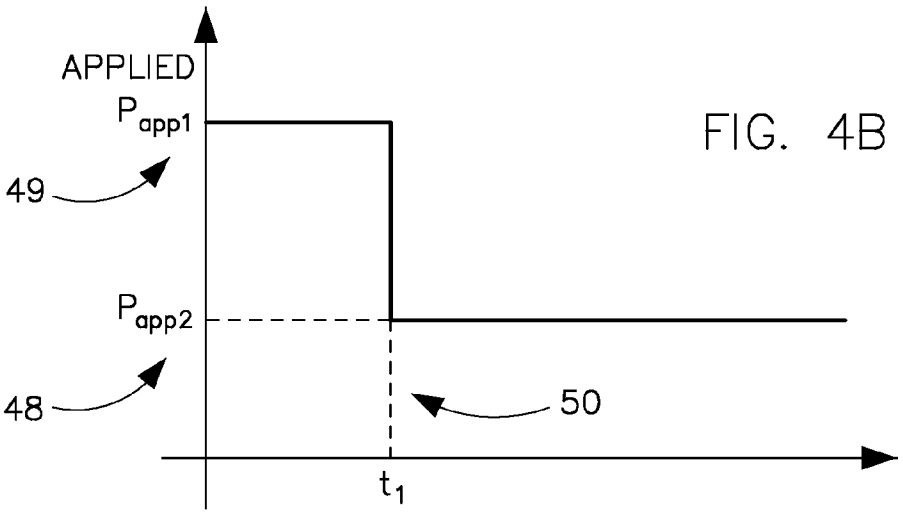
FIGS. 4A-4C are graphs that illustrate controlling of power applied to the electron emitter in the electron gun of FIG. 1 according to two distinct power curves.
Figure 4C:
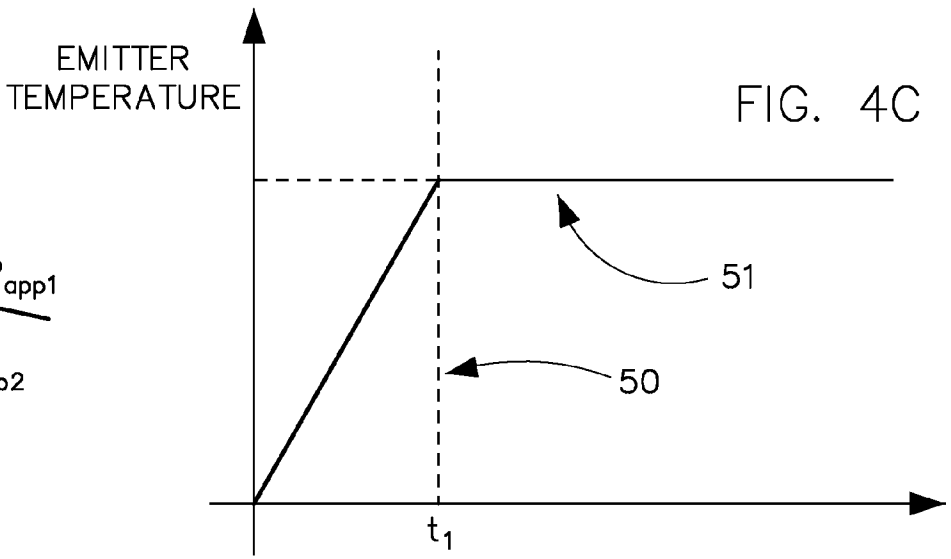
Figure 4A:
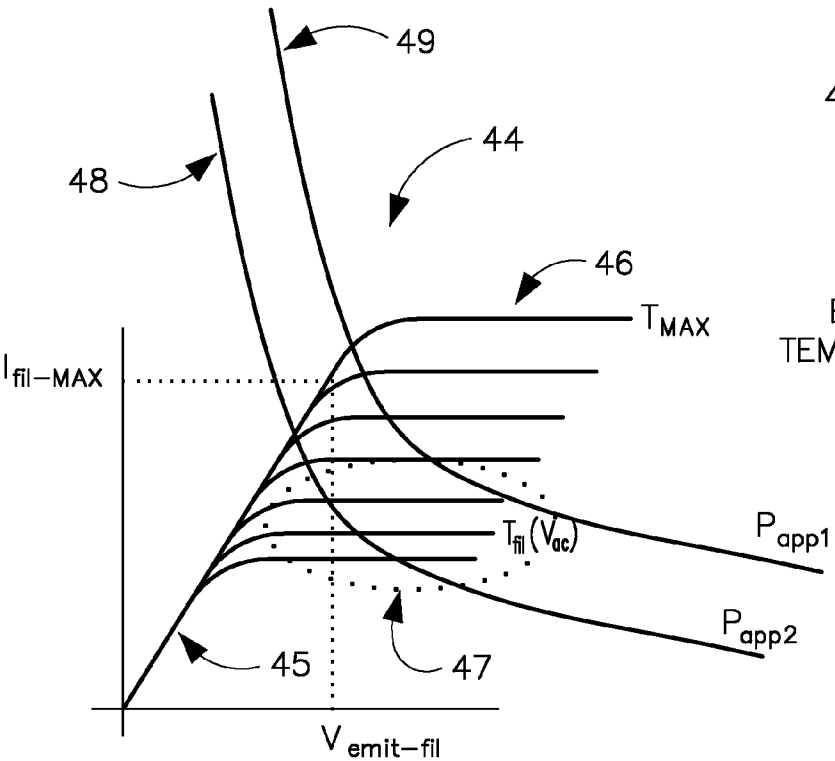

According to an embodiment of the invention, and as shown in FIG. 4A, it is recognized that controlling of power applied to the electron emitter can be performed in control zone 47 according to two distinct power curves 48, 49 (rather than the single power curve 48 shown in FIG. 3). That is, power may be initially applied for a specified period of time according to a first power curve 49 in order to bring the electron emitter up to its desired operating temperature in a minimum amount of time. Upon the electron emitter reaching its desired operating temperature, power can then be applied according to a second power curve 48, with the power applied according to the second power curve 48 being maintained for a duration of operation of electron gun 10 (FIG. 1). As shown in FIGS. 4B and 4C, power is initially applied according to first power curve 49 up to a time $t_1$, indicated at 50. At time $t_1$, the electron emitter reaches its desired operating temperature, indicated at 51. Thus at time $t_1$, power is applied according to second power curve 48, and the applied power is maintained along the second power curve 48 for a duration of operation of the electron gun.

Figure 5:
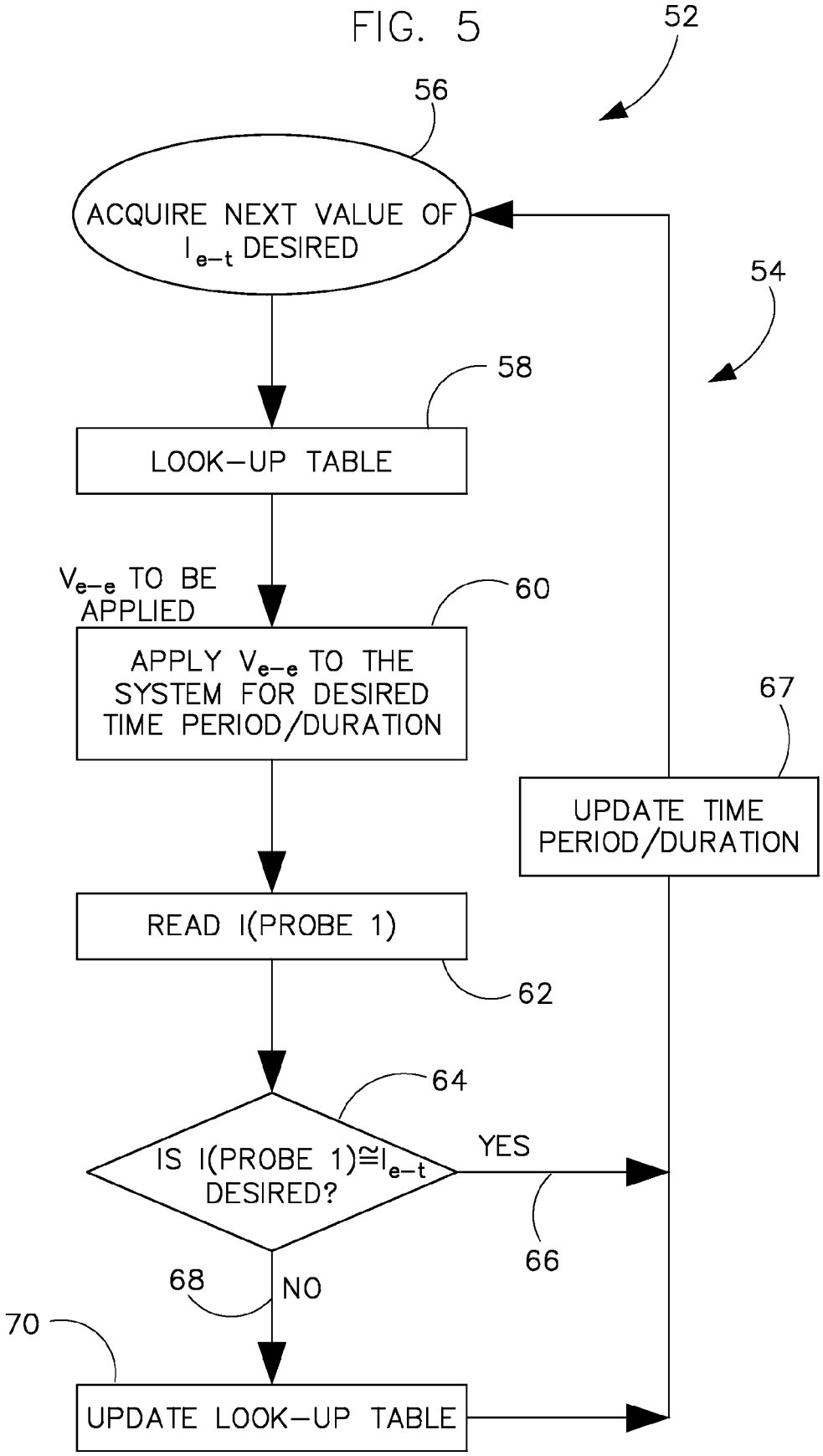
FIG. 5 is a flowchart illustrating a first control loop in a technique for controlling operation of a Pierce-type electron gun in accordance with an embodiment of the present invention.
Figure 6:
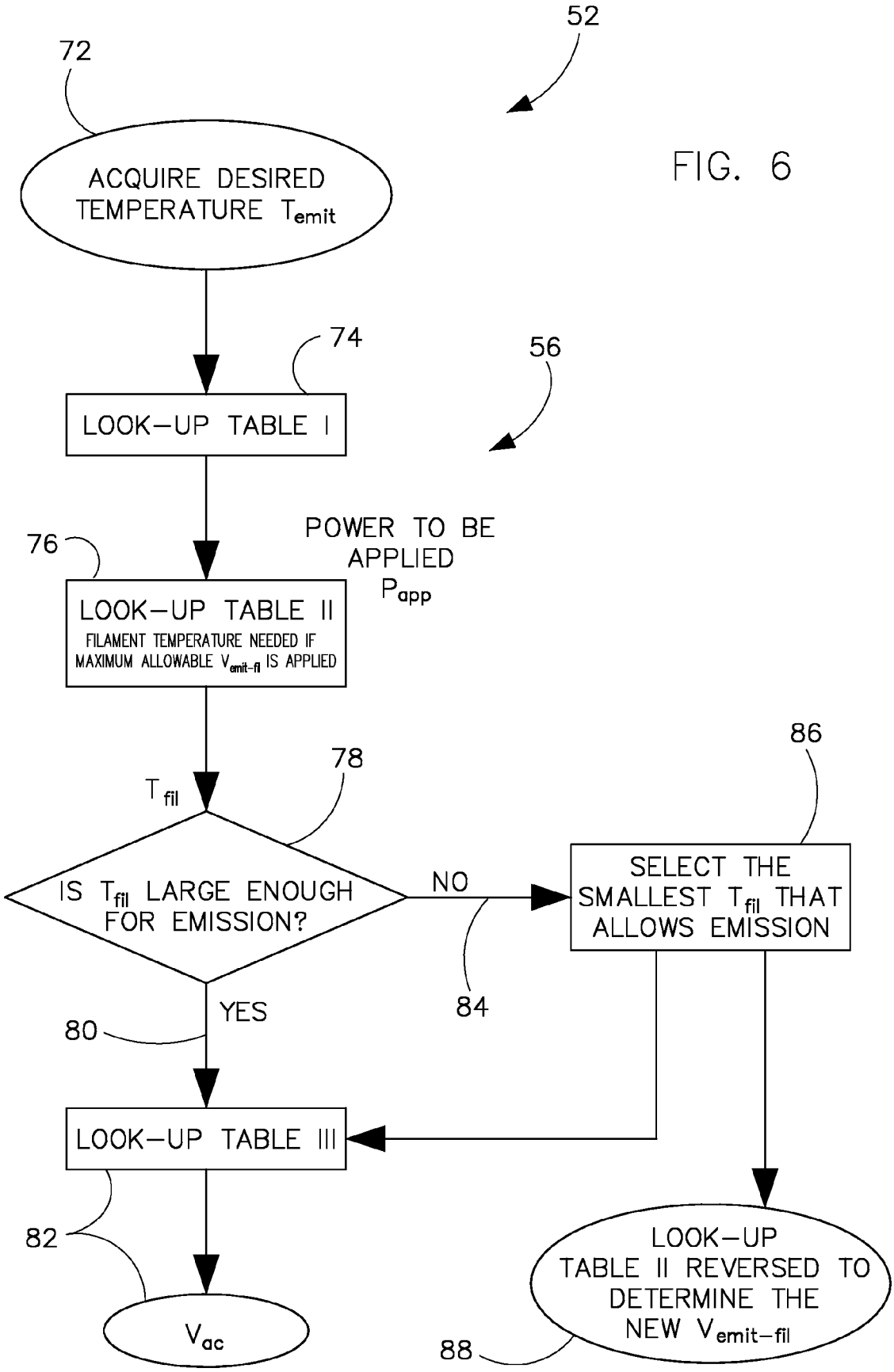
FIGS. 6 and 7 are a flowchart illustrating a second control loop in a technique for controlling operation of a Pierce-type electron gun in accordance with an embodiment of the present invention.
Figure 7:
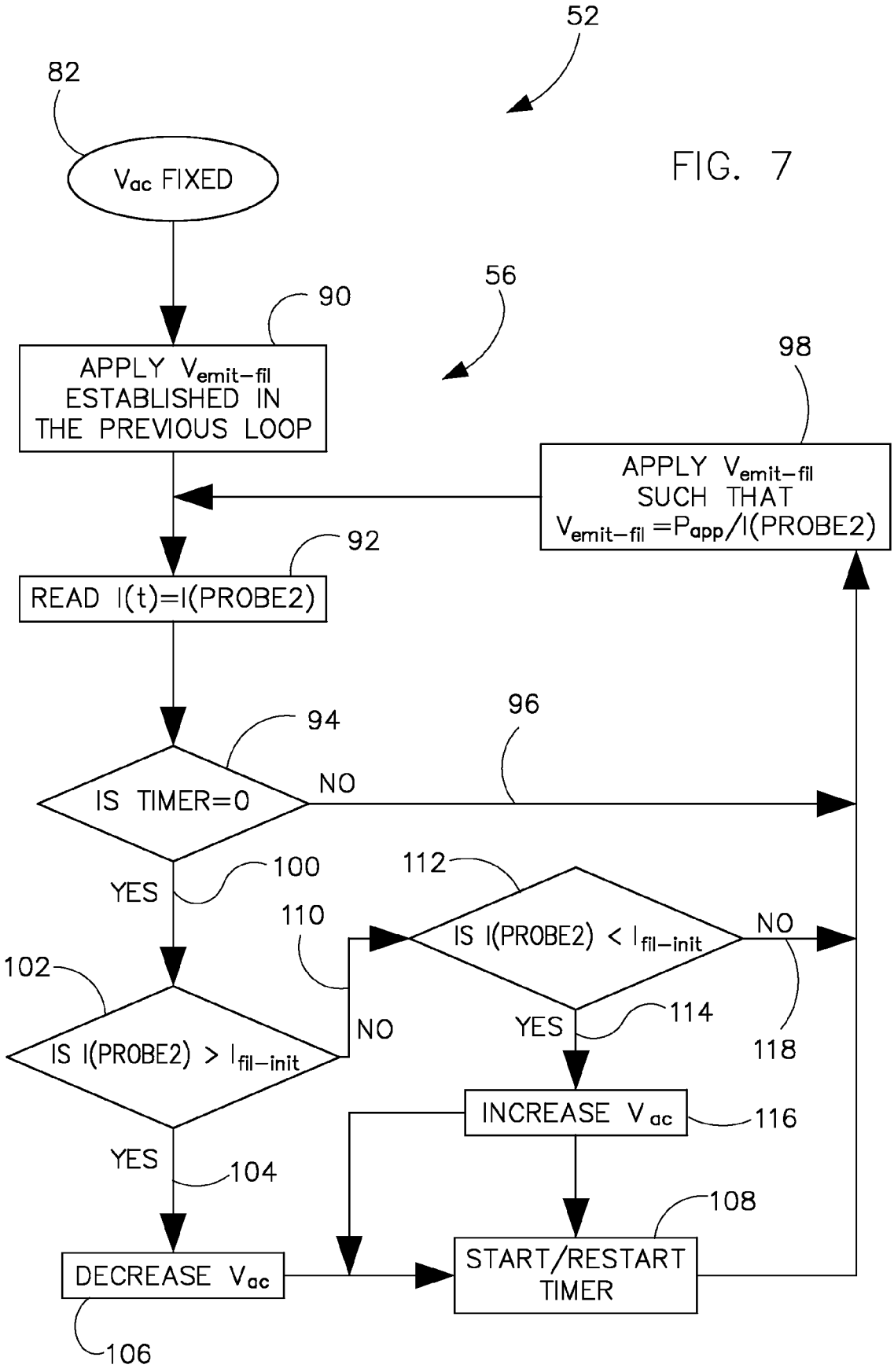

Referring now to FIGS. 5-7, and with continued reference to FIG. 1, flowcharts illustrating a technique 52 for controlling operation of electron gun 10 is set forth. Technique 52 can, for example, be performed by a control system provided in the electron gun electronics, such as control system 34. The technique 52 implements first and second control loops 54 (FIG. 5), 56 (FIGS. 6 and 7) for controlling the current in the electron beam 14 and controlling the operating temperature of the electron emitter 20 and the filament 22, so as to keep the temperature of both the electron emitter 20 and the filament 22 to their lowest possible operating temperature.

Referring to FIG. 5, first control loop 54 is illustrated for controlling the current in the electron beam 14. The first control loop 54 begins with receiving or acquisition of an input at STEP 57 that is indicative of a desired electron beam current of electron beam 28 that is to be generated by electron gun 10. Upon receipt of the input of the desired electron beam current, a desired voltage to be applied between the electron emitter 20 and the extraction plate 24 (emitter-extraction plate voltage, $V_{e-e}$) is determined at STEP 58 based on the desired electron beam current. According to an exemplary embodiment of the invention, a lookup table is accessed in order to determine the voltage to be applied between electron emitter 20 and extraction plate 24 that is needed to generate an electron beam 14 having the desired current.

Upon determination of the desired voltage to be applied between the electron emitter 20 and the extraction plate 24, $V_{e-e}$, such as by way of a lookup table, the desired voltage is then applied between the electron emitter 20 and the extraction plate 24 at STEP 60 by way of power supply and control system, with the desired voltage being applied for a desired time interval (i.e., a "time on" duration) recognized as the desired period of time/duration of the electron beam 14 being on. Application of voltage $V_{e-f}$, between the electron emitter element 20 and the filament 22, along with a supply of voltage $V_{ac}$ to filament 22 discussed in detail below, results in the electron emitter element 20 reaching the desired temperature. As the electron emitter element 20 is at the operative temperature, application of the voltage $V_{e-e}$ between the electron emitter 20 and the extraction plate 24 results in an emission of an electron beam 14. In order to determine/verify whether the generated electron beam 14 has a current value equal to the desired current value that was received at STEP 56, a real-time value of the current density of the emitted electron beam 14 is measured at STEP 62, such as by way of first probe 30 that is positioned along electrical path 28 at a point between power supply 26 and electron emitter element 20. At STEP 64, the real-time current measured by first probe 30 is compared to the initially desired electron beam current and a determination is made as to whether the measured real-time current is approximately equal to the initially desired electron beam current, or instead is "different" in that it varies by more than a pre-determined amount.

According to one embodiment of the invention, at STEP 64, a measured real-time current is considered to be approximately equal to the initially desired electron beam current if the difference between the value of the measured real-time current and the value of the initially desired electron beam current is less than +/−5% of the value of the initially desired electron beam current. The measured real-time current is considered to be different to the initially desired electron beam current if the difference between the value of the measured real-time current and the value of the initially desired electron beam current is greater than +/−5% of the value of the initially desired electron beam current. Such a threshold range introduces tolerances and hysteresis for stability purposes in the electron gun.

If the two current values are found to be approximately equal 66, then it is determined that electron gun 10 has not experienced any unexpected operative conditions. The first control loop 54 continues at STEP 67, where the time interval/period is modified, before the first control loop 54 then loops back to STEP 57, where a next desired electron beam current is input/received. The time interval is thus modified at STEP 67 every time the first control loop 54 loops back. First control loop 54 is then repeated for the next desired electron beam current that was input/received, with the voltage applied between the electron emitter 20 and the extraction plate 24 being modified as needed so as to generate an electron beam 14 having the updated desired electron beam current and the updated desired "time on" duration.

If the two current values are found to be "different" 68 (i.e., differ by greater than a pre-determined amount), then it is determined that electron gun 10 may have experienced an unexpected operative condition and that a correlation between a given electron beam current and the voltage applied between the electron emitter 20 and the extraction plate 24 needed to generate that given electron beam current has changed as compared to the correlation set forth in the original lookup table. Therefore, the lookup table is updated at STEP 70 to reflect the unexpected operative condition, such that a more accurate relationship between the electron beam current and the voltage applied between the electron emitter 20 and the extraction plate 24 is provided. Upon updating of the lookup table, the time on duration is updated at STEP 67, and the first control loop 54 loops back to STEP 57, where a next desired electron beam current and time on duration 67 are input/received. First control loop 54 is then repeated for the next desired electron beam current and on-time interval that were input/received, with the voltage to be applied between the electron emitter 20 and the extraction plate 24 for the updated desired electron beam current being determined by way of the updated lookup table.

The first control loop 54 of technique 52 is thus implemented for controlling a current in the electron beam 14 by way of controlling the voltage applied between the electron emitter 20 and the extraction plate 24, $V_{e\text{-}e}$. For a given desired current in the electron beam 14, the voltage applied between the electron emitter 20 and the extraction plate 24 is kept constant, such that an electron beam 14 having the desired electron beam current intensity will be reliably extracted, without unwanted current variations. Additionally, the first control loop 54 provides for quick termination of electron beam emission by way of controlling the voltage applied between the electron emitter 20 and the extraction plate 24. That is, first control loop 54 provides for the application of voltage on the extraction plate 24 only when emission is required and after the voltage is regulated to the desired value, such that when emission is not desired, the voltage between the emitter element 20 and the extraction plate 24 can be kept to a negative value.

Referring now to FIGS. 6 and 7, second control loop 56 is illustrated for controlling the operating temperature of the electron emitter 20 and the filament 22, so as to keep the temperature of both the electron emitter 20 and the filament 22 to their lowest possible operating temperature. While the second control loop 56 of FIGS. 6 and 7 is shown separately from the first control loop 54 of FIG. 5, it is recognized that the second control loop 56 could be implemented prior to, or simultaneously with, the first control loop.

As shown in FIG. 6, second control loop 56 is initiated with the receiving or acquisition/calculation of an input indicative of a desired operating temperature for electron emitter element 20 at STEP 72. The desired electron emitter element operating temperature is calculated/chosen to be the minimum temperature that allows for operation of the electron emitter element in a charge limited operation mode for the largest electron beam intensity required by the electron gun. Upon receipt of the input of the desired electron emitter element operating temperature, a power to be applied to the emitter element 20, $P_{app}$, is determined at STEP 74 based on the desired emitter element operating temperature. According to an exemplary embodiment of the invention, a lookup table is accessed in order to determine the power to be applied to the emitter element 20 that corresponds to the desired emitter element operating temperature. Upon determination of power to be applied to the emitter element 20, another lookup table is accessed at STEP 76 to determine a filament temperature associated with the determined power. More specifically, in determining the filament temperature, it is assumed that a maximum allowable voltage ($V_{e\text{-}f}$) will be applied between the electron emitter element 20 and the filament 22 for the determined power. For this maximum allowable voltage applied between the electron emitter element 20 and the filament 22, the lookup table provides an associated filament temperature needed to provide a filament current $I_{fil}$ ($I_{fil}$ being the current emitted by the filament), corresponding to the maximum voltage between the electron emitter element 20 and the filament 22 for the determined power.

While STEPS 74 and 76 are described above as accessing separate lookup tables for determining power to be applied to the emitter element 20 and a needed filament temperature, respectively, it is recognized that both settings could be obtained from a single lookup table. That is, based on the geometry of the electron emitter element 20 and the filament 22, relationships between the desired emitter element operating temperature, the power to be applied to the emitter element 20, and the needed filament temperature could be obtained from a single lookup table (given the maximum $V_{e\text{-}f}$ that can be applied).

Upon determining a filament temperature associated with the maximum allowable voltage between the electron emitter element 20 and the filament 22, a determination is made at STEP 78 as to whether the determined filament temperature is sufficient to cause emission of $I_{fil}$ from the filament 22 to the electron emitter element 20. That is, it is determined at STEP 78 whether the determined filament temperature is sufficient for heating electron emitter element 20 for causing emission of an electron beam 14. If the determined filament temperature is sufficient to cause emission of $I_{fil}$ 80, then the second control loop 56 continues with determination of an initial voltage to apply to filament ($V_{ac}$) at STEP 82 that is based on the determined filament operating temperature. According to an exemplary embodiment, a lookup table is accessed at STEP 82 in order to determine the initial voltage to apply to the filament 22 based on the associated filament operating temperature.

If it is determined that the filament temperature obtained at STEP 76 is not sufficient to cause emission of $I_{fil}$ 84, then the second control loop 56 continues with a selection or identification of the smallest filament temperature that provides for emission of $I_{fil}$ at STEP 86. Upon identification of the smallest filament temperature that provides for emission, the second control loop 56 then proceeds to STEP 82, where the initial voltage to apply to filament 22 is determined based on identified smallest filament operating temperature providing for emission, such as by way of a lookup table. Upon identification of the smallest filament temperature that provides for emission, the second control loop 56 also proceeds to STEP 88 to determine a modified value of the voltage to be applied between the electron emitter element 20 and the filament 22 based on the smallest filament temperature that provides for emission. Essentially, the determination of the modified voltage to be applied between the electron emitter element 20 and the filament 22 at STEP 88 is made by using a reverse lookup table from that used in STEP 76. As the filament temperature that provides for emission is already known, a reverse lookup table can be accessed at STEP 88 to determine a voltage to be applied between the electron emitter element 20 and the filament 22 that corresponds to that minimum filament emission temperature.

Referring now to FIG. 7, upon setting of the initial voltage to be applied to the filament 22 and the initial voltage to be applied between the electron emitter element 20 and the filament 22, the determined initial voltages are then applied to both the filament 22 and between the electron emitter element 20 and the filament 22 at STEP 90. Power is provided by power supply 26 and control system 34 functions to individually control the magnitude of the voltage applied to the filament 22 and the initial voltage to be applied between the electron emitter element 20 and the filament 22 according to their respective determined initial voltage levels. Upon application of voltages to the electron emitter element 20 and filament 22, a real-time value of current in filament 22 is measured at STEP 92, such as by way of second probe 32 that is positioned along electrical path 29 at a point between power supply 26 and filament 22.

After a measurement of the real-time value of current in filament 22 has been acquired, a determination is made at STEP 94 regarding whether a pre-determined time interval has passed between application of the initial voltages and measurement of the real-time filament current. According to an exemplary embodiment, such a determination can be made by setting a timer and determining if the timer has expired at the time of the measurement (the timer being desired for stable operations). If the timer has not expired 96, the second control loop 56 continues at STEP 98, where a voltage applied between the electron emitter element 20 and the filament 22 is recalculated based on the measured real-time filament current. The voltage between the electron emitter element 20 and the filament 22, $V_{e\text{-}f}$, can be determined according to:

$$V_{e\text{-}f}=P_{app}/I_{probe2} \quad \text{[Eqn. 1]},$$

where $P_{app}$ is the power applied to the emitter element 20, and $I_{probe2}$ is the real-time filament current measured by the second probe 32. The modified/updated amplitude of $V_{e\text{-}f}$ is then applied between the electron emitter element 20 and the filament 22, and the second control loop 56 loops back to STEP 92, where a real-time filament current is again measured. The voltage adjustment is necessary to compensate for heating reflected back by the electron emission element 20.

If a determination is made at STEP 94 that the timer has expired 100, the second control loop 56 continues at STEP 102, where the measured real-time filament current, $I_{probe2}$ measured by the second probe 32, is compared to an initial filament current, $I_{fil\text{-}init}$, and a determination is made if the real-time filament current is greater than the initial filament current. It is noted that the initial filament current need not be measured, but is determined based on the power supplied $P_{app}$, and the voltage applied between the electron emitter element 20 and the filament 22, $V_{e\text{-}f}$ established in STEP 76 or 88. If a determination is made at STEP 102 that the real-time filament current is greater than the initial filament current 104, then the second control loop 56 continues by decreasing a value of voltage applied to the filament 22 at STEP 106 and resetting the timer at STEP 108, before continuing to STEP 98, where a voltage applied between the electron emitter element 20 and the filament 22 is recalculated based on the measured real-time filament current, and the recalculated/modified voltage is applied.

If a determination is made at STEP 102 that the real-time filament current is not greater than the initial filament current 110, then the second control loop 56 continues at STEP 112, where the measured real-time filament current, $I_{probe2}$, is again compared to the initial filament current, $I_{fil\text{-}init}$, for purposed of determining if the real-time filament current is less than the initial filament current. If a determination is made at STEP 112 that the real-time filament current is less than the initial filament current 114, then the second control loop 56 continues by increasing a value of voltage applied to the filament 22 at STEP 116 and resetting the timer at STEP 108, before continuing to STEP 98, where a voltage applied between the electron emitter element 20 and the filament 22 is recalculated based on the measured real-time filament current, and the recalculated/modified voltage is applied. If a determination is made at STEP 112 that the real-time filament current is not less than the initial filament current 118, then it is determined that the real-time filament current is equal to the initial filament current, and the value of voltage applied to the filament 22 is maintained at its present value. The second control loop 56 then continues at STEP 98, where a voltage applied between the electron emitter element 20 and the filament 22 is recalculated based on the measured real-time filament current, and the recalculated/modified voltage is applied.

Figure 8:
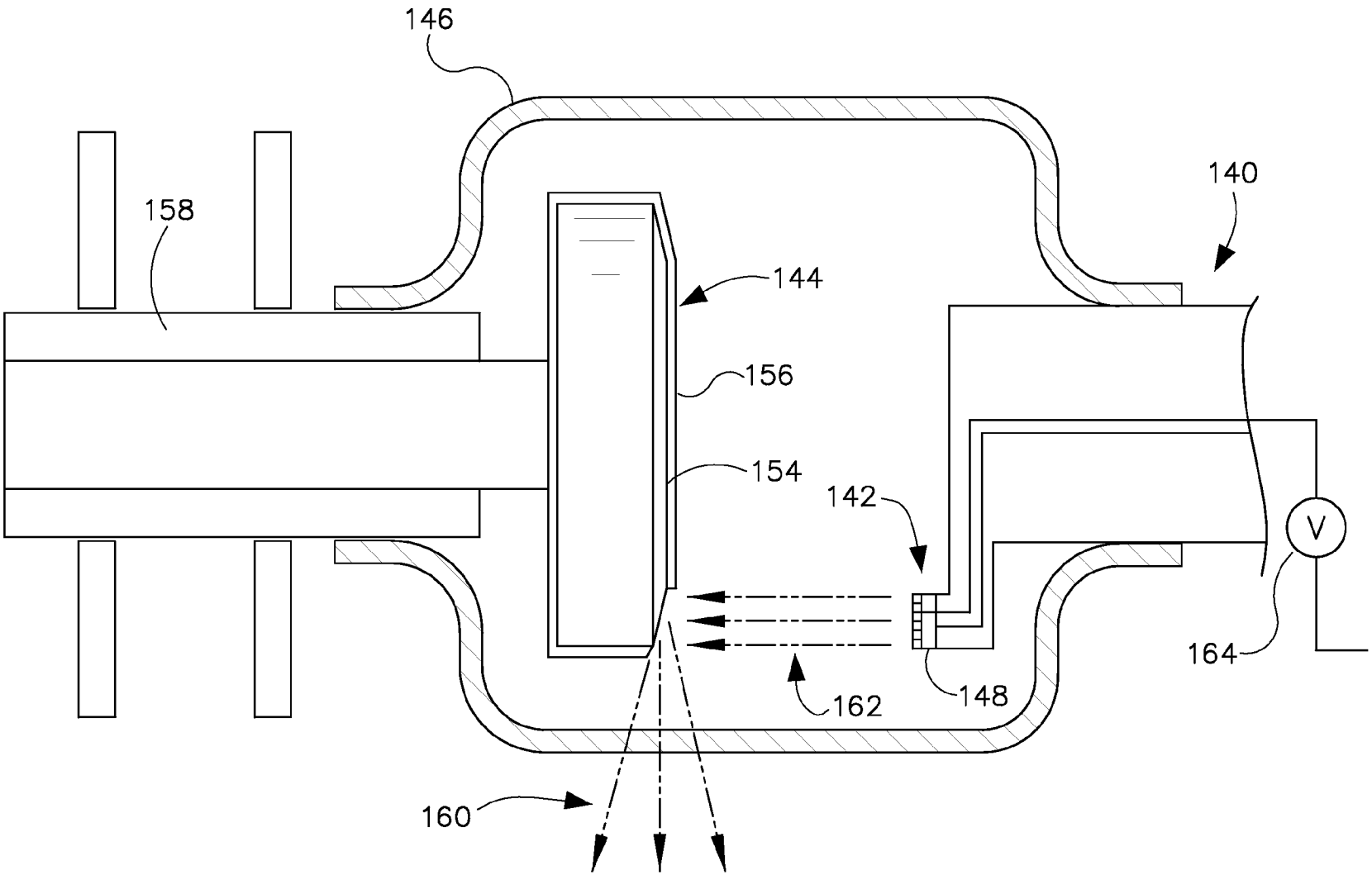
FIG. 8 is a schematic view of an x-ray source in accordance with an embodiment of the present invention.

Referring now to FIG. 8, an x-ray generating tube 140, such as for a CT system, is shown that incorporates an electron gun for generating an electron beam, in accordance with an embodiment of the invention. Principally, x-ray tube 140 includes a cathode assembly 142 and an anode assembly 144 encased in a housing 146, with cathode assembly 142 being a Pierce-type electron gun cathode constructed in accordance with the cathode structure 12 of FIG. 1 and that is controlled by a control system 34 (FIG. 1). Anode assembly 144 includes a rotor 158 configured to turn a rotating anode disc 154 and anode shield 156 surrounding the anode disc, as is known in the art. When struck by an electron current 162 from cathode assembly 142, anode 156 emits an x-ray beam 160 therefrom.

Figure 9:
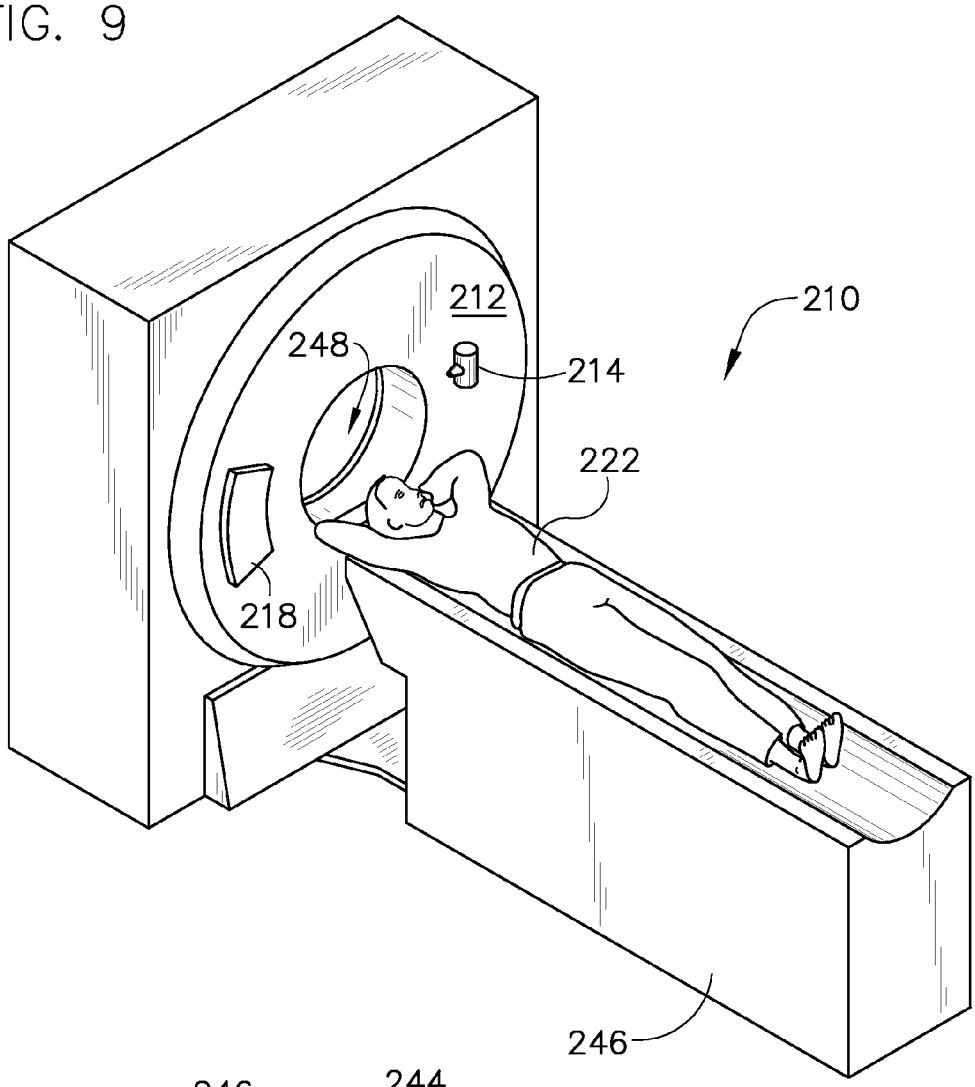
FIG. 9 is a perspective view of a CT imaging system incorporating an embodiment of the present invention.
Figure 10:
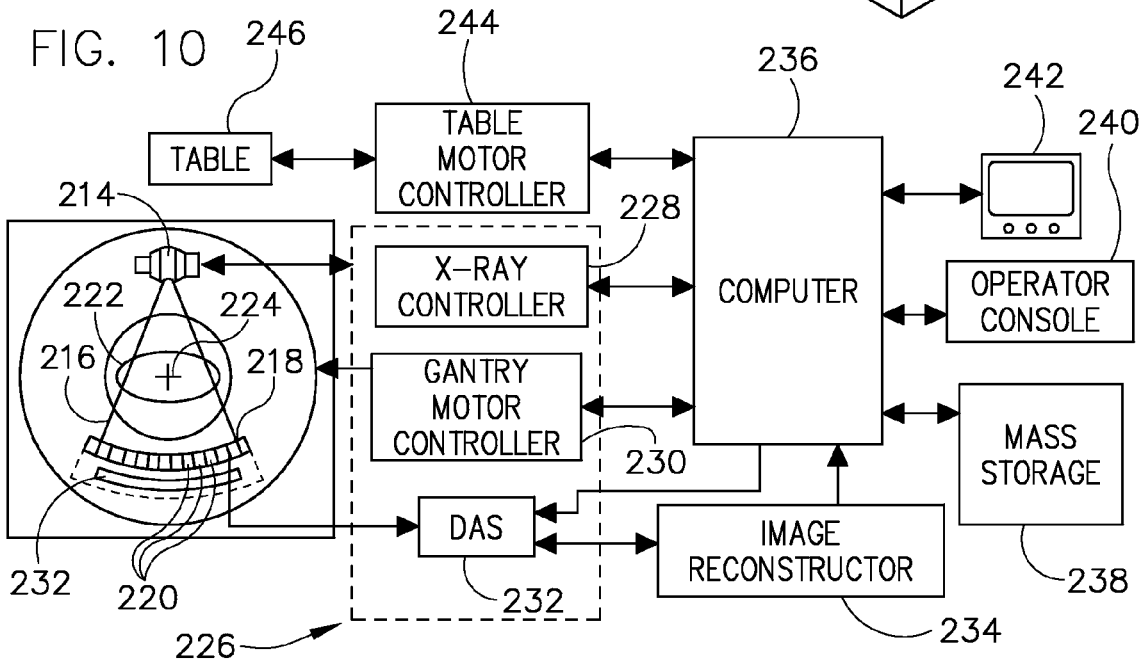
FIG. 10 is a schematic block diagram of the system illustrated in FIG. 8.

Referring to FIG. 9, a computed tomography (CT) imaging system 210 is shown as including a gantry 212 representative of a "third generation" CT scanner. Gantry 212 has an x-ray source 214 that rotates thereabout and that projects a beam of x-rays 216 toward a detector assembly or collimator 218 on the opposite side of the gantry 212. X-ray source 214 includes an x-ray tube having an electron gun 10 as shown and described in FIG. 1. Referring now to FIG. 10, detector assembly 218 is formed by a plurality of detectors 220 and data acquisition systems (DAS) 232. The plurality of detectors 220 sense the projected x-rays that pass through a medical patient 222, and DAS 232 converts the data to digital signals for subsequent processing. Each detector 220 produces an analog electrical signal that represents the intensity of an impinging x-ray beam and hence the attenuated beam as it passes through the patient 222. During a scan to acquire x-ray projection data, gantry 212 and the components mounted thereon rotate about a center of rotation 224.

Rotation of gantry 212 and the operation of x-ray source 214 are governed by a control mechanism 226 of CT system 210. Control mechanism 226 includes an x-ray controller 228 that provides power, control, and timing signals to x-ray source 214 and a gantry motor controller 230 that controls the rotational speed and position of gantry 12. An image reconstructor 234 receives sampled and digitized x-ray data from DAS 232 and performs high speed reconstruction. The reconstructed image is applied as an input to a computer 236 which stores the image in a mass storage device 238.

Computer 236 also receives commands and scanning parameters from an operator via console 240 that has some form of operator interface, such as a keyboard, mouse, voice activated controller, or any other suitable input apparatus. An associated display 242 allows the operator to observe the reconstructed image and other data from computer 236. The operator supplied commands and parameters are used by computer 236 to provide control signals and information to DAS 232, x-ray controller 228 and gantry motor controller 230. In addition, computer 236 operates a table motor controller 244 which controls a motorized table 246 to position patient 222 and gantry 212. Particularly, table 246 moves patients 222 through a gantry opening 248 of FIG. 9 in whole or in part.

A technical contribution for the disclosed system and method is that is provides for a computer implemented technique for controlling operation of a Pierce-type electron gun to control current density in the emitted electron beam and control the operating temperature of the electron emitter and the filament, so as to keep the temperature of both the electron emitter and the filament to their lowest possible operating temperature.

Therefore, according to one embodiment of the invention, an apparatus includes a filament configured to generate heat when a voltage is applied thereto, an electron emitter heated by the filament to generate an electron beam, and a power supply configured to supply power to each of the filament and the electron emitter, the power supply including a plurality of voltage supplies. The apparatus also includes a control system to control a supply of power to each of the filament and the electron emitter, with the control system being configured to receive an input indicative of a desired electron emitter operating temperature, cause a desired voltage to be applied between the electron emitter and the filament, and cause a desired voltage to be applied to the filament based on the desired emitter element operating temperature, so as to minimize an operating temperature of the electron emitter and the filament.

According to another embodiment of the invention, a method for controlling operation of an electron gun includes instituting a first control loop to control a current in an electron beam, wherein instituting the first control loop further includes providing a desired electron beam current, applying a potential between the electron emitter and the extraction electrode to generate an electron beam having the desired current, and applying the electron beam for a desired period of time. The method also includes instituting a second control loop to control an operating temperature of the electron emitter and the filament, wherein instituting the second control loop further includes providing a desired electron emitter operating temperature, applying a potential between the electron emitter and the filament and a potential across the filament, so as to control the operating temperature of the electron emitter and the filament.

According to yet another embodiment of the invention, a control system includes including a processor programmed to receive an input indicative of a desired electron beam current, an electron beam emission time duration, and a desired electron emitter operating temperature, cause a voltage to be applied between the electron emitter and the extraction electrode for the desired time interval and based on the desired electron beam current, and cause an initial voltage to be applied between the electron emitter and the filament based on the desired emitter element operating temperature. The processor is further programmed to cause an initial filament voltage to be applied based on the initial voltage between the emitter element and the filament, compare a measured filament current value to an initial filament current value, with the initial filament current value associated with the initial filament voltage and a voltage between the electron emitter element and the filament, and modify each of the initial filament voltage and the initial voltage between the electron emitter and the filament based on the comparison of the measured filament current and the initial filament current.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. An apparatus for controlling power supplied to an electron gun comprising:

a filament configured to generate heat when a voltage is applied thereto;

an electron emitter heated by the filament to generate an electron beam;

a power supply configured to supply power to each of the filament and the electron emitter, wherein the power supply comprises a plurality of voltage supplies;

a first current sensor to measure a first current at a point along an electrical path between the power supply and the electron emitter;

a second current sensor to measure a second current at a point along an electrical path between the power supply and the filament;

a control system to control a supply of power to each of the filament and the electron emitter, the control system configured to:

receive an input indicative of a desired electron emitter operating temperature;

cause a power to be applied to the electron emitter and cause an initial voltage to be applied between the electron emitter and the filament, with the power to be applied to the electron emitter and the initial voltage to be applied between the electron emitter and the filament being based on the desired electron emitter operating temperature;

cause an initial filament voltage to be applied based on the initial voltage between the emitter element and the filament and a determined filament operating temperature;

compare the second current to an initial filament current;

cause a modified filament voltage to be applied based on the comparison of the second current and the initial filament current; and cause a modified voltage to be applied between the electron emitter and the filament based on the comparison of the second current and the initial filament current.

2. The apparatus of claim 1 further comprising: an extraction electrode positioned adjacent to the electron emitter to extract the electron beam out therefrom, the extraction electrode electrically connected to the power supply to receive power therefrom; and a target anode positioned in a path of the electron beam and configured to emit a beam of high-frequency electromagnetic energy when the electron beam impinges thereon; wherein the control system is configured to: receive an input indicative of a desired electron beam current; and cause a desired voltage to be applied between the electron emitter and the extraction electrode based on the desired electron beam current, so as to generate an electron beam having the desired electron beam current.

3. The apparatus of claim 2 wherein the control system is configured to:

compare the first current to the desired electron beam current; and if the first current differs from the desired electron beam current by a pre-determined amount, then cause a modified voltage to be applied between the electron emitter and the extraction electrode based on the difference between the first current and the desired electron beam current.

4. The apparatus of claim 3 wherein the control system is configured to:

access a look-up table to determine the desired voltage to be applied between the electron emitter and the extraction electrode based on the desired electron beam current; and modify the look-up table if the first current differs from the desired electron beam current by the pre-determined amount.

5. The apparatus of claim 2 wherein the control system is configured to:

receive an input indicative of a desired electron beam time-on duration; and cause the desired voltage to be applied between the electron emitter and the extraction electrode for the desired electron beam time-on duration, so as to generate an electron beam having the desired electron beam current for the desired time-on duration.

6. The apparatus of claim 1 wherein the control system is configured to: cause the power to be applied to the electron emitter at a first level for a specified period of time; and cause the power to be applied to the electron emitter at a second level after the specified period of time has passed; wherein the specified period of time corresponds to an amount of time needed to bring the emitter element to the desired electron emitter operating temperature.

7. The apparatus of claim 1 wherein the control system is configured to access a look-up table to determine each of the initial voltage between the electron emitter and the filament and the initial filament voltage.

8. The apparatus of claim 1 wherein the control system is configured to operate the electron emitter in a charge limited mode and the filament in a temperature limited mode.

9. The apparatus of claim 1 wherein the control system is configured to compare the second current to the initial filament current at pre-determined intervals.

* * * * *